United States Patent [19]

Travis

[11] 4,085,943

[45] Apr. 25, 1978

[54] SELF EJECTING DRILL CHUCK KEY

[75] Inventor: Sigmund D. Travis, Brookfield, Ill.

[73] Assignee: C. R. Reichel Engineering Co. Inc., San Francisco, Calif.

[21] Appl. No.: 731,782

[22] Filed: Oct. 12, 1976

[51] Int. Cl.[2] ..... B25B 13/44

[52] U.S. Cl. ..... 279/1 K; 81/90 A

[58] Field of Search ..... 279/1 K; 81/90 A, 71; 83/140

[56] References Cited

U.S. PATENT DOCUMENTS 2,609,719 9/1952 Lilley ..... 81/90 A 2,660,081 11/1953 Dossie ..... 279/1 K

*Primary Examiner*—J. M. Meister

*Attorney, Agent, or Firm*—Owen, Wickersham & Erickson

[57] ABSTRACT

A self-ejecting key device for drill chucks has a main body with a handle, a key element and a forward guide pin with a groove along one side for retaining a slidable ejector member. The groove is aligned with a bore that extends through the key element and main body. Retained within the bore is a coiled spring which is secured to a slidable ejector pin in the groove that projects outwardly from the side of the guide pin.

5 Claims, 3 Drawing Figures

SELF EJECTING DRILL CHUCK KEY

BACKGROUND OF THE INVENTION

This invention relates to an improved self-ejecting key for drill chucks and the like.

Key devices of various types have long been used to lock and unlock drill chucks by engaging a toothed gear segment on the rotary chuck. When used, it is essential that the key device be removed to prevent it from being thrown about by the chuck as it commences to rotate. It has been known heretofore to utilize an injector means on such key devices to assure their removal from the chuck before the drill device is started. Such an arrangement is shown in U.S. Pat. No. 2,660,081. In this patent the key assembly comprised a body, a key element and a pin, all three components being integral and coaxially aligned. A bore was provided parallel to the longitudinal axis and extending through all three components. Within this bore was an ejector pin and a coiled spring retained by transverse handle in the body of the device. The ejector pin extended from one side of the pin but was prevented from extending to the outer end of the pin by an internal shoulder. The aforesaid arrangement was found to have two major disadvantages. First, since the ejector pin was prevented from extending all of the way to the outer end of the key pin, it was possible on some occasions to leave a key device partially engaged within a chuck with the usual unfavorable consequences. Secondly, the structural arrangement of the aforesaid patented key device made it relatively expensive to manufacture, particularly in large quantities.

Accordingly, a general object of the invention is to overcome the aforesaid disadvantages and provide an improved self-ejecting key device for drill chucks.

Another more specific object of the present invention is to provide a self-ejecting key device for drill chucks which assures positive ejection from the chuck each time it is used.

Another object of the present invention is to provide a self-ejecting key device for drill chucks that has relatively few parts and is particularly well adapted for ease and economy of manufacture.

BRIEF SUMMARY OF THE INVENTION

The aforesaid objects are accomplished by a key device comprised of a main body having a transverse handle, a pinion type key element with a plurality of teeth adapted to mesh with similar teeth on a drill chuck and a frontal pin portion. These three components are integral and are axially aligned. Extending from the outer end of the pin portion is a groove whose longitudinal axis is parallel to but spaced to one side of the central axis of the pin portion. This groove extends to the key element and then becomes a bore of the same diameter which extends through and terminates within the body. An ejector pin device is slidably retained in the groove with one end flush with the end of the grooved pin portion. The other end of the ejector pin is attached to a coil spring secured in the end of the bore. Thus, when the key is used in a chuck the ejector pin is pushed against the spring to compress it, and when the force applied to maintain the key is released, the key automatically ejects from the chuck.

Other objects, advantages and features of the invention will become apparent from the following detailed description, taken in conjunction with the accompanying drawings.

DETAILED DESCRIPTION OF A PREFERRED EMBODIMENT

Figure 1:
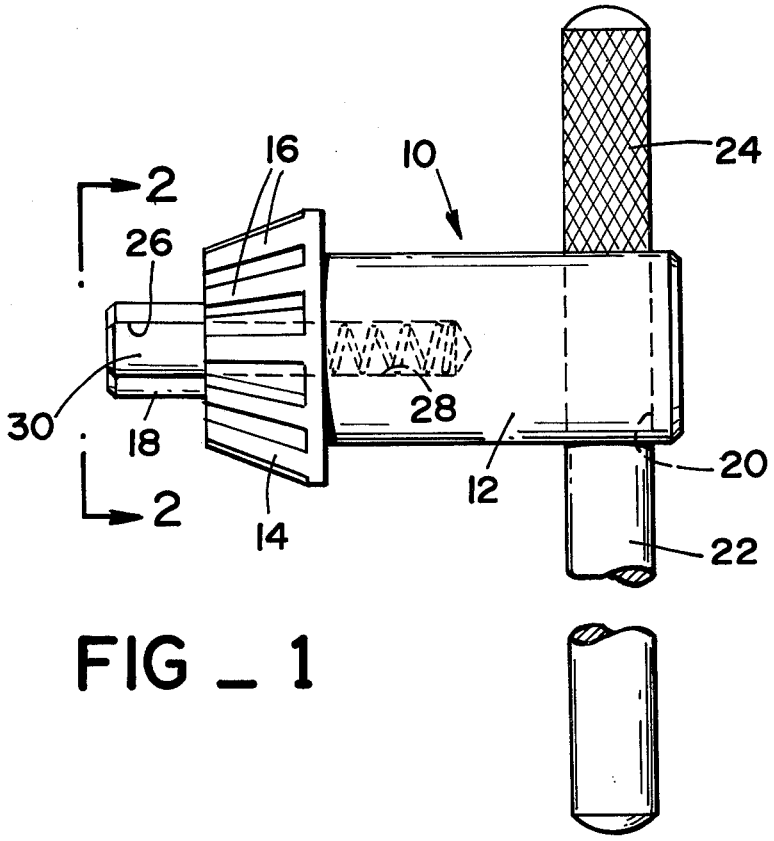
FIG. 1 is a view in elevation of a self-ejecting drill chuck key device embodying principles of the present invention.

With reference to the drawing, FIG. 1 illustrates a self-ejecting key device 10 according to the present invention which comprises generally a main rear body portion 12, a key element 14 in the form of beveled teeth 16 and a forward pin portion 18. As with drill chuck key devices heretofore devised, the pin portion is adapted to fit within a hole in the outer cylindrical surface of a drill chuck as the beveled teeth of the key element mesh with a toothed ring on the chuck.

Near the rear end of the main body portion 12 is a transverse bore 20 within which is retained an elongated handle 22, preferably provided with knurling 24.

At the front end of the key device is a groove 26 that extends the full length of the forward pin portion 18. This groove has an axis that is parallel to but offset to one side from the central axis of the key device that extends through the pin portion, key element and body portion. In the embodiment shown, the groove 26 has a circular cross section with substantially more than 180° of the circle being within one side of the forward pin portion 18. Axially aligned with the groove is a bore 28 of the same diameter that extends through the key element 14 and into the main body 12 of the device.

Figure 2:
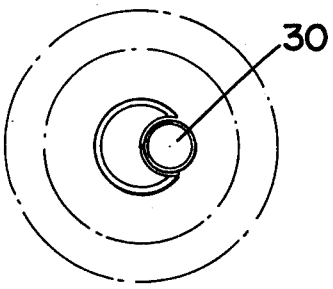
FIG. 2 is a front end view of the key device shown in FIG. 1.

Slidably retained in the groove 26 and extending into the bore 28 is an ejection pin 30. This pin is generally cylindrical in the embodiment shown, and thus a portion of it extends outside of the groove 26 and outside of the cylindrical surface of the forward pin 18, as best seen in FIG. 2.

Figure 3:
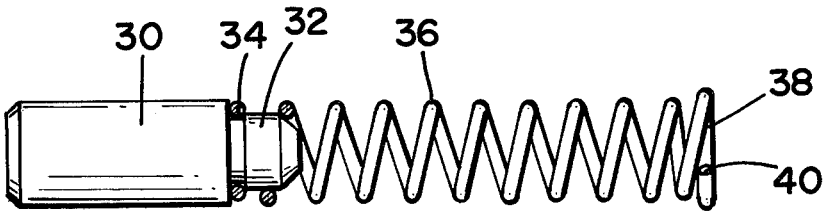
FIG. 3 is an enlarged view of the ejection pin for the device of FIG. 1.

This ejection pin as seen in the enlarged view of FIG. 3, preferably has a chamfered front end, and at its rear end is a short retaining knob portion 32 having a smaller diameter than the main body of the pin 30 and separated therefrom by a necked portion forming an annular groove 34. Retained within this circular groove is the forward loop of a coil spring 36. The outside diameter of all but the innermost coil of this spring is essentially the same as that of the main ejection pin. The last or innermost loop or coil 38 of the spring 36, which is open with a free end 40, has a diameter that is greater than the other coils.

The construction of the key device 10 as described makes it particularly adaptable for high volume, low unit cost production. After an integral unit with the combined body, key element and forward guide pin components are initially formed, either by casting or machining, a boring tool may be used to form the side groove 26 in the forward pin and the bore 28 in the key element and main body. The ejection pin 30 is preassembled with the spring 36 by forcing its forward loop over the knob portion 32 and into the annular groove 34. The combined ejection pin and spring subassembly is now pushed into the bore 28 with the innermost enlarged spring loop 38 wedged tightly in place at the bottom of the bore to hold it in place. The spring and ejection pin are sized so that with no compression force on the pin, its outer end face is flush with that of the fixed forward pin portion of the device.

In use, when the forward pin portion of the device 10 is pressed into the side hole of a drill chuck so as to engage the key element with the chuck teeth, the ejection pin 30 which projects outside the periphery of the side hole is pushed back against coil spring 36. Thus, a constant force is required to keep the key device in its operative position on the chuck and whenever this force is released, the spring force on the pin 30 will push it forward and eject the device from the chuck.

To those skilled in the art to which this invention relates, many changes in construction and widely differing embodiments and applications of the invention will suggest themselves without departing from the spirit and scope of the invention. The disclosures and the description herein are purely illustrative and are not intended to be in any sense limiting. For example, although the invention has been described with particular reference to a drill chuck key it may also be applicable to a lathe chuck key. In such a device the key element comprising a plurality of teeth would not be required, but the slidable ejector would be constructed and would function in the same way.

I claim:

1. A self ejecting drill chuck key device comprising:

a key element with a plurality of teeth adapted to mesh with matching teeth of a drill chuck assembly;

a main body extending axially from one end of said key element and having a handle member;

a guide pin extending from the other end of said key element and being axially aligned with said element and said body, said guide pin having a groove on one side along its full length, said groove being axially aligned with a bore that extends through said element and terminates within said body, said bore having a larger cross section than said groove;

and a slidable ejector member within said groove having an outer end that remains essentially flush with the outer end of said pin when said device is not in use and spring means attached to the inner end of said ejector member and extending within said bore for allowing retraction of said ejector member upon movement of said key element into its operative position.

2. The device as described in claim 1 wherein said bore has a circular cross section and said groove has a partial circular cross section with the same diameter as said bore.

3. The device as described in claim 1 wherein said spring means comprises a plurality of coils including an enlarged innermost coil that is formed with a nominal diameter which is larger than the diameter of said bore when not confined therein.

4. The device as described in claim 2 wherein said ejector member is a cylindrical pin within said groove having an annular groove for retaining one end of said spring means.

5. A self ejecting chuck key device comprising:

a main body having a handle member;

a guide pin axially aligned with said element and said body, said guide pin having a groove on one side along its full length, said groove being axially aligned with a bore that extends into and terminates within said body, said bore having a larger cross section than said groove;

and a slidable ejector member within said groove having an outer end that remains essentially flush with the outer end of said pin when said device is not in use and spring means attached to the inner end of said ejector member and extending within said bore for allowing retraction of said ejector member upon movement of said device into its operative position.

* * * * *